US011098936B2

(12) United States Patent
Tang

(10) Patent No.: US 11,098,936 B2
(45) Date of Patent: Aug. 24, 2021

(54) MULTI-SPLIT SYSTEM AND LIQUID RETURN PREVENTION CONTROL METHOD THEREOF

(71) Applicants: GD MIDEA HEATING & VENTILATING EQUIPMENT CO., LTD., Foshan (CN); MIDEA GROUP CO., LTD., Foshan (CN)

(72) Inventor: Changjing Tang, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 116 days.

(21) Appl. No.: 16/355,351

(22) Filed: Mar. 15, 2019

(65) Prior Publication Data

US 2019/0212045 A1 Jul. 11, 2019

Related U.S. Application Data

(63) Continuation of application No. PCT/CN2017/084223, filed on May 12, 2017.

(30) Foreign Application Priority Data

Nov. 7, 2016 (CN) ..... 201610978533.6

(51) Int. Cl.
*F25B 47/02* (2006.01)
*F24F 11/42* (2018.01)
(Continued)

(52) U.S. Cl.
CPC ..... *F25B 47/025* (2013.01); *F24F 3/065* (2013.01); *F24F 11/42* (2018.01); *F24F 11/64* (2018.01);
(Continued)

(58) Field of Classification Search
CPC ..... F25B 47/025; F25B 2400/23; F25B 2600/0253; F25B 2600/2515;
(Continued)

(56) References Cited

U.S. PATENT DOCUMENTS

2015/0267957 A1 9/2015 Kim et al.
2017/0336116 A1* 11/2017 Fukui ..... F25B 43/00
2019/0063793 A1* 2/2019 Tang ..... F25B 43/006

FOREIGN PATENT DOCUMENTS

CN 102272534 A 12/2011
CN 103528142 A 1/2014
(Continued)

OTHER PUBLICATIONS

Guangdong Midea HVAC Equipment Co., Ltd., International Search Report, PCT/CN2017/084223, dated Sep. 8, 2017, 20 pgs.
(Continued)

*Primary Examiner* — Marc E Norman
(74) *Attorney, Agent, or Firm* — Morgan, Lewis & Bockius LLP

(57) ABSTRACT

A multi-split air conditioning system and liquid return prevention control method thereof. When the multi-split air conditioning system is in heating operation, the multi-split air conditioning system is switched to a defrosting mode to operate for defrosting if an outdoor unit receives a defrosting instruction. After detecting gas exhaust pressure, gas return pressure and gas exhaust temperature of a compressor in real time, the multi-split air conditioning system sends a defrosting completion signal to a diverter, controls the compressor to reduce frequency and a plurality of electric-control valves to open, and controls any one of the electric-control valves to open and the rest of the electric-control valves to close during reversing of a four-way valve, so as to reduce the amount of a refrigerant returned to a low-pressure gas-liquid separator.

15 Claims, 2 Drawing Sheets

(51) Int. Cl.

| | |
|---|---|
| ***F24F 11/64*** | (2018.01) |
| ***F24F 11/84*** | (2018.01) |
| ***F24F 11/85*** | (2018.01) |
| ***F24F 3/06*** | (2006.01) |
| *F24F 140/12* | (2018.01) |

(52) U.S. Cl.
CPC ..... *F24F 11/84* (2018.01); *F24F 11/85* (2018.01); *F24F 2140/12* (2018.01); *F25B 2400/23* (2013.01); *F25B 2600/0253* (2013.01); *F25B 2600/2515* (2013.01); *F25B 2700/1931* (2013.01); *F25B 2700/21152* (2013.01)

(58) Field of Classification Search
CPC ..... F25B 2700/1931; F25B 2700/1933; F25B 2700/21152; F24F 3/065; F24F 11/42; F24F 11/64; F24F 11/84; F24F 11/85
See application file for complete search history.

(56) References Cited

FOREIGN PATENT DOCUMENTS

| | | | |
|---|---|---|---|
| CN | 105509257 | A | 4/2016 |
| CN | 105556196 | A | 5/2016 |
| CN | 105723168 | A | 6/2016 |
| CN | 205619641 | U | 10/2016 |
| CN | 106524336 | A | 3/2017 |
| JP | 2002147905 | A | 5/2002 |
| JP | 2006118764 | A | 5/2006 |
| JP | 2007271094 | A | 10/2007 |
| JP | 2009257697 | A | 11/2009 |

OTHER PUBLICATIONS

Guangdong Midea HVAC Equipment Co., Ltd., First Office Action, Chinese Application No. CN 201610978533.6, dated Sep. 30, 2018, 4 pgs.

* cited by examiner

MULTI-SPLIT SYSTEM AND LIQUID RETURN PREVENTION CONTROL METHOD THEREOF

CROSS-REFERENCE TO RELATED APPLICATIONS

This application is a continuation application of PCT/CN2017/084223, entitled "MULTI-SPLIT SYSTEM AND LIQUID RETURN PREVENTION CONTROL METHOD THEREOF" filed on May 12, 2017, which claims priority to Chinese Patent Application No. 201610978533.6, entitled "MULTI-SPLIT SYSTEM AND LIQUID RETURN PREVENTION CONTROL METHOD THEREOF" filed with the State Intellectual Property Office of P. R. China on Nov. 7, 2016, the entire contents of both of which are incorporated herein by reference.

TECHNICAL FIELD

The present disclosure relates to a field of air conditioners, and more particularly to a control method of anti-liquid-return of a multi-split air conditioning system and a multi-split air conditioning system.

BACKGROUND

The multi-split air conditioning system is generally used for cooling and heating in the four seasons. When the multi-split air conditioning system works in a heating mode, the system transfers heat from outside to inside. The outdoor heat exchanger operates as an evaporator, the indoor heat exchanger operates as a condenser, and the compressor is used to discharge gas at a high temperature to exchange heat with indoor air. The gas transfers the heat to the indoor air and thus is condensed as a fluid. The fluid is returned to the outdoor unit through a throttling device, and is evaporated after heat exchange with outdoor air.

When the ambient temperature of the outdoor unit is below the freezing point, the water vapor in the outdoor air is condensed on the surface of the evaporator and becomes frost. The frosting of the evaporator increases the resistance of the heat transfer between the surface and the air and increases the flow resistance, such that the air flow rate of the evaporator is reduced and the heat exchange efficiency is significantly reduced, resulting in a reduced capacity of the heat exchange between the outdoor environment and the refrigerant and a decreased outlet air temperature. Especially in some low temperature and high humidity conditions, the outdoor heat exchanger is severely frosted, and the evaporation effect of the refrigerant in the outdoor heat exchanger is gradually deteriorated, such that more liquid refrigerant is gradually returned to the low-pressure gas-liquid separator, and the working condition of the system is deteriorated, causing a liquid return problem of the system when severe deterioration happens. Therefore, defrosting measures should be taken in due course when the multi-split air conditioning system works in the heating mode.

In the current defrosting manner, a four-way valve is used to switch the system to a refrigerating mode, such that the outdoor heat exchanger is converted to a condenser, the indoor unit is converted to an evaporator, and the outdoor heat exchanger is defrosted due to a high-temperature gaseous refrigerant from the compressor. However, due to a large amount of refrigerant of the multi-split air conditioning system and a relative long distance between the outdoor unit and the indoor unit, the amount of additional refrigerant in the system is also large. In the heating mode and the main heating mode, when the outer working conditions are relatively poor, the outdoor heat exchanger is frosted very quickly. Especially under the conditions of low temperature and high humidity, like snow and ice, the evaporation effect of the outdoor heat exchanger becomes worse. The refrigerant is gradually stored in a fluid reservoir of the compressor, i.e., the low-pressure gas-liquid separator, and occupies most of the volume of the low-pressure gas-liquid separator, and thus liquid level of the low-pressure gas-liquid separator is relative high before the defrosting starts. When the four-way valve is switched for the first time, the system is switched to a refrigerating mode in a reverse cycle. When the outdoor heat exchanger is defrosted, the four-way valve is switched for the second time and the system is switched to the heating or main heating mode. The large amount of liquid refrigerant may be returned from the outdoor heat exchanger to the low-pressure gas-liquid separator at an inlet of the compressor, and thus a large amount of liquid is returned to the compressor. Therefore, it is difficult for current multi-split air conditioning systems to perform defrosting under the premise of ensuring the safe and reliable operation of the system.

SUMMARY

Embodiments of the present disclosure seek to solve at least one of the problems existing in the related art to at least some extent. Accordingly, an object of the present disclosure is to provide a control method of anti-liquid-return of a multi-split air conditioning system, which may prevent liquid return after defrosting and improve safety and reliability of the system.

A second object of the present disclosure is to provide a multi-split air conditioning system.

In order to realize the above objects, embodiments of a first aspect of the present disclosure provide a control method of anti-liquid-return of a multi-split air conditioning system, in which the multi-split air conditioning system includes an outdoor unit, a shunt device and a plurality of indoor units, in which the outdoor unit includes a low-pressure gas-liquid separator, a compressor, a four-way valve and an outdoor heat exchanging assembly, the outdoor heat exchanging assembly includes a plurality of heat exchanging channels and a plurality of heat exchanging units each communicating with a respective one of a plurality of heat exchanging channels, an electric control valve is provided in each heat exchanging channel, the method includes: controlling the multi-split air conditioning system to switch to a defrosting mode to perform defrosting if a defrosting instruction is received by the outdoor unit when the multi-split air conditioning system works in a heating mode; detecting a gas discharge pressure, a gas return pressure and a gas discharge temperature of the compressor in real time; after defrosting is completed, sending a defrosting completion signal to the shunt device from the outdoor unit, controlling the compressor to reduce frequency and a plurality of electric control valves to open, and controlling one of the plurality of electric control valves to open and the rest of the plurality of electric control valves to close when the four-way valve switches, so as to reduce an amount of a refrigerant returned to the low-pressure gas-liquid separator, and adjusting the number of open electric control valves in a preset period according to the gas discharge pressure, the gas return pressure and the gas discharge temperature.

With the control method of anti-liquid-return of a multi-split air conditioning system according to embodiments of the present disclosure, when the multi-split air conditioning system works in a heating mode, the multi-split air conditioning system is controlled to switch to a defrosting mode to perform defrosting if a defrosting instruction is received. After defrosting is completed, when the four-way valve switches, the number of open electric control valves are decreased to reduce the amount of the refrigerant returned to the outdoor unit and the number of open electric control valves is adjusted in the preset period according to the gas discharge pressure, the gas return pressure and the gas discharge temperature. Therefore, proper functioning of the multi-split air conditioning system may be ensured, and the risk of the liquid returning to the compressor after the defrosting may also be prevented, thus improving the safety and reliability of the system.

In addition, the control method of anti-liquid-return of a multi-split air conditioning system according to above embodiment of the present disclosure may also have following additional technical features.

In an embodiment of the present disclosure, a plurality of electric control valves consists of a first electric control valve, a second electric control valve and a third electric control valve when the number of a plurality of heat exchanging channels are three, and the first electric control valve and the second electric control valve are controlled to close and the third electric control valve is controlled to open when the four-way valve switches.

Specifically, adjusting the number of open electric control valves in a preset period according to the gas discharge pressure, the gas return pressure and the gas discharge temperature includes: determining the gas discharge pressure, the gas return pressure and the gas discharge temperature; controlling the second electric control valve to open and the first electric control valve to remain closed, i.e., opening the second and third electric control valves and keeping the first electric control valve closed, when the gas discharge pressure is higher than or equal to a first high pressure threshold, the gas return pressure is lower than a first low pressure threshold, or the gas discharge temperature is higher than or equal to a first temperature threshold.

Further, adjusting the number of open electric control valves in a preset period according to the gas discharge pressure, the gas return pressure and the gas discharge temperature further includes: controlling the first electric control valve to open, i.e., opening all the electric control valves, when the gas discharge pressure is higher than or equal to a second high pressure threshold, the gas return pressure is lower than a second low pressure threshold, or the gas discharge temperature is higher than or equal to a second temperature threshold, in which the second high pressure threshold is greater than the first high pressure threshold, the second low pressure threshold is smaller than the first low pressure threshold, and the second temperature threshold is greater than the first temperature threshold.

In an embodiment of the present disclosure, the multi-split air conditioning system is in a main heating mode or a pure heating mode when the multi-split air conditioning system works in a heating mode.

In addition, embodiments of the present disclosure provide a non-transitory computer-readable storage medium having stored therein computer programs that, when executed by a processor, cause the processor to perform a control method of anti-liquid-return described above.

In order to realize the above objects, embodiments of a second aspect of the present disclosure provide a multi-split air conditioning system including a plurality of indoor units; a shunt device; an outdoor unit, in which the outdoor unit includes a low-pressure gas-liquid separator, a compressor, a four-way valve and an outdoor heat exchanging assembly, the outdoor heat exchanging assembly includes a plurality of heat exchanging channels and a plurality of heat exchanging units each communicating with a respective one of a plurality of heat exchanging channels, an electric control valve is provided in each heat exchanging channel; a detecting module configured to detect a gas discharge pressure, a gas return pressure and a gas discharge temperature of the compressor in real time; a controlling module configured to control the multi-split air conditioning system to switch to a defrosting mode to perform defrosting if a defrosting instruction is received by the outdoor unit when the multi-split air conditioning system works in a heating mode, in which after defrosting is completed, a defrosting completion signal is sent to the shunt device from the outdoor unit, the compressor is controlled to reduce frequency, a plurality of electric control valves are controlled to open, and one of the plurality of electric control valves is controlled to open and the rest of the plurality of electric control valves are controlled to close when the four-way valve switches, so as to reduce an amount of a refrigerant returned to the low-pressure gas-liquid separator, and the number of open electric control valves is adjusted in a preset period according to the gas discharge pressure, the gas return pressure and the gas discharge temperature.

With the multi-split air conditioning system according to embodiments of the present disclosure, when the multi-split air conditioning system works in a heating mode, the multi-split air conditioning system is controlled to switch to a defrosting mode to perform defrosting if a defrosting instruction is received by the outdoor unit. After defrosting is completed, when the four-way valve switches, the number of open electric control valves are decreased to reduce the amount of the refrigerant returned to the outdoor unit and the number of open electric control valves is adjusted in the preset period according to the gas discharge pressure, the gas return pressure and the gas discharge temperature. Therefore, proper functioning of the multi-split air conditioning system may be ensured, and the risk of the liquid returning to the compressor after the defrosting may also be prevented, thus improving the safety and reliability of the system.

In addition, the multi-split air conditioning system according to above embodiment of the present disclosure may also have following additional technical features.

In an embodiment of the present disclosure, the plurality of electric controlled valves consists of a first electric control valve, a second electric control valve and a third electric control valve when the number of a plurality of heat exchanging channels are three, and the outdoor unit is configure to control the first electric control valve and the second electric control valve to close and the third electric control valve to open when the four-way valve switches.

Specifically, the outdoor unit is configured to determine the gas discharge pressure, the gas return pressure and the gas discharge temperature, in which the outdoor unit is configured to control the second electric control valve to open and the first electric control valve to remain closed, i.e., to open the second and third electric control valves and to keep the first electric control valve closed, when the gas discharge pressure is higher than or equal to a first high pressure threshold, the gas return pressure is lower than a first low pressure threshold, or the gas discharge temperature is higher than or equal to a first temperature threshold.

Further, the outdoor unit is configured to control the first electric control valve to open, i.e., to open all the electric control valves, when the gas discharge pressure is higher than or equal to a second high pressure threshold, the gas return pressure is lower than a second low pressure threshold, or the gas discharge temperature is higher than or equal to a second temperature threshold, in which the second high pressure threshold is greater than the first high pressure threshold, the second low pressure threshold is smaller than the first low pressure threshold, and the second temperature threshold is greater than the first temperature threshold.

In an embodiment of the present disclosure, the multi-split air conditioning system is in a main heating mode or a pure heating mode when the multi-split air conditioning system works in a heating mode.

DETAILED DESCRIPTION

Figure 1:
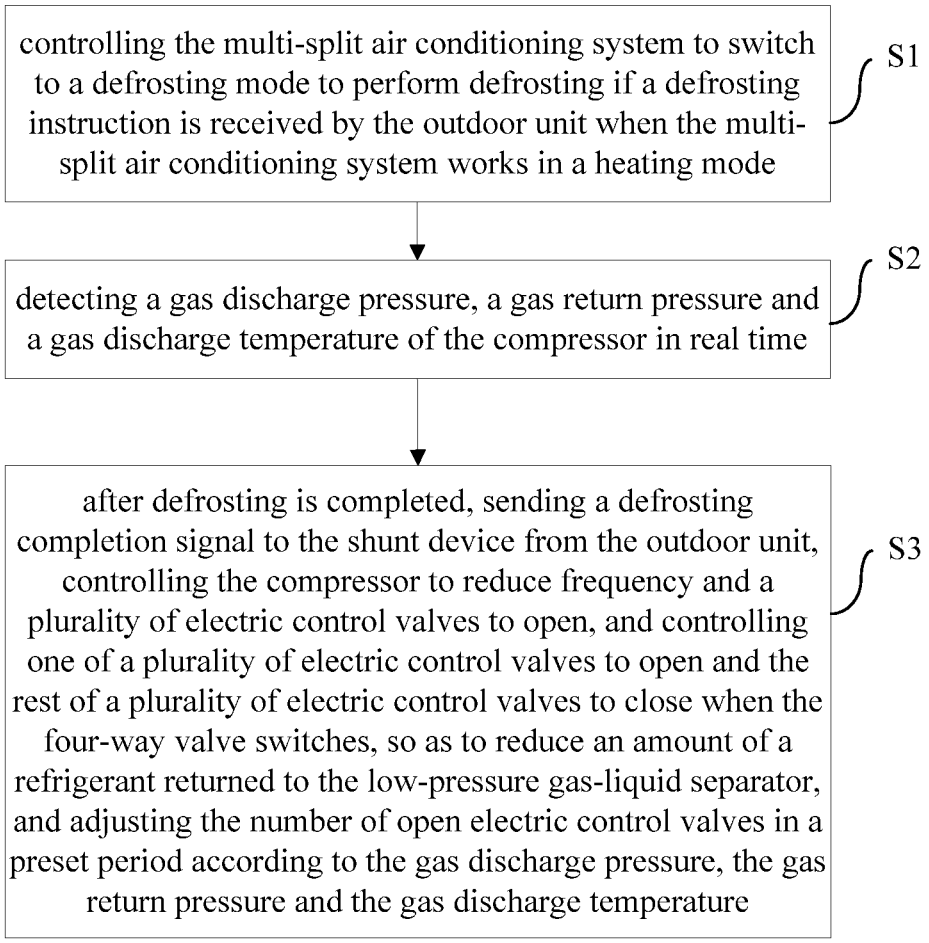
FIG. 1 is a flow chart of a control method of anti-liquid-return of a multi-split air conditioning system according to an embodiment of the present disclosure.

Embodiments of the present disclosure will be described in detail and examples of embodiments are illustrated in the drawings. The same or similar elements and the elements having same or similar functions are denoted by like reference numerals throughout the descriptions. Embodiments described herein with reference to drawings are explanatory, serve to explain the present disclosure, and are not construed to limit embodiments of the present disclosure.

Hereinafter, a control method of anti-liquid-return of a multi-split air conditioning system according to embodiments of the present disclosure will be described with reference to the accompanying drawings.

FIG. 1 is a flow chart of a control method of anti-liquid-return of a multi-split air conditioning system according to an embodiment of the present disclosure.

Figure 2:
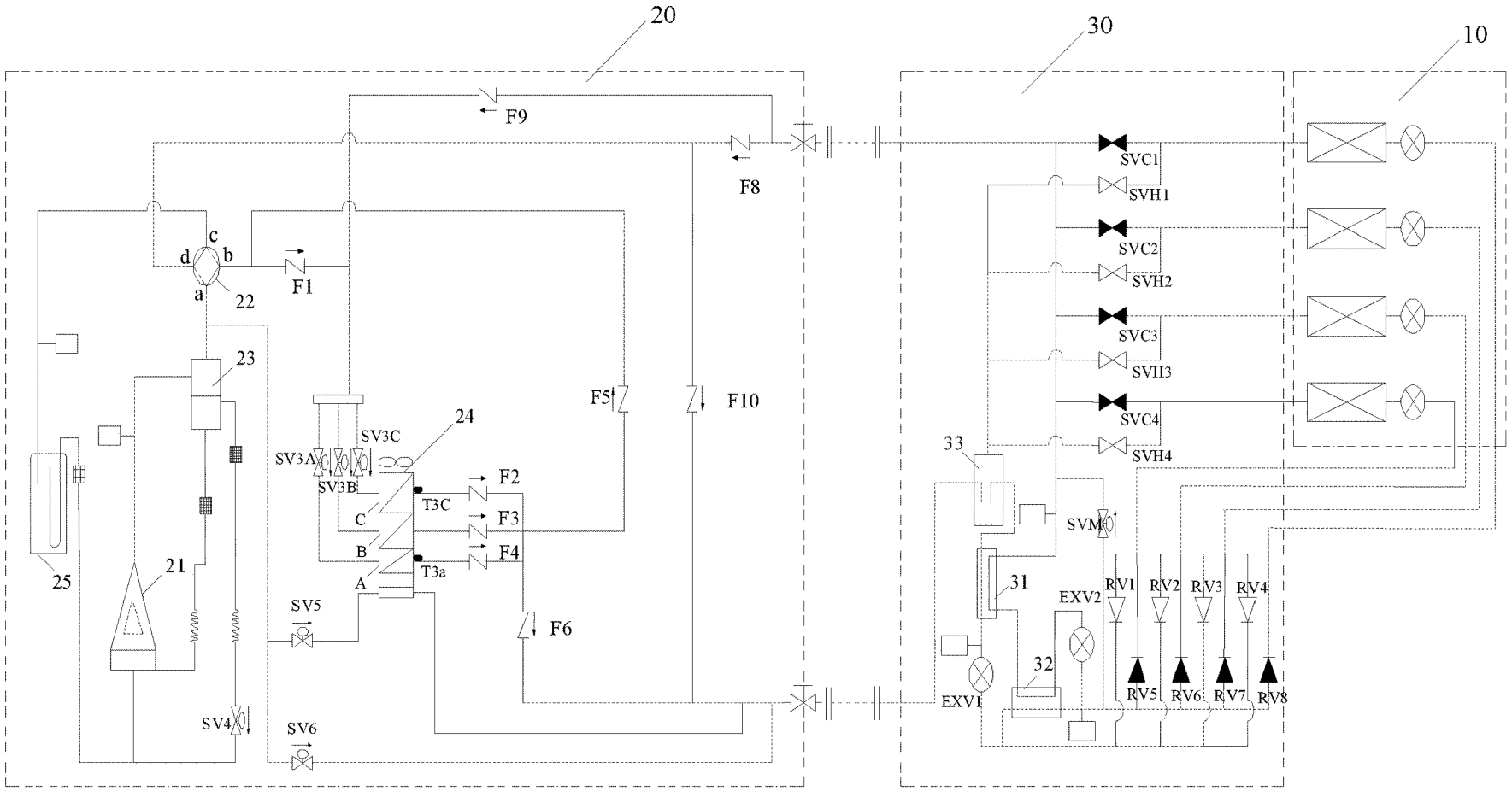
FIG. 2 is a schematic diagram of a multi-split air conditioning system according to an embodiment of the present disclosure.

Specifically, it can be seen from FIG. 2, the multi-split air conditioning system according to an embodiment of the present disclosure may include an outdoor unit, a shunt device and a plurality of indoor units, in which the outdoor unit includes a low-pressure gas-liquid separator, a compressor, a four-way valve and an outdoor heat exchanging assembly, the outdoor heat exchanging assembly includes a plurality of heat exchanging channels and a plurality of heat exchanging units each communicating with a respective one of a plurality of heat exchanging channels, an electric control valve is provided in each heat exchanging channel. In a specific embodiment, the electric control valve is an electromagnetic valve.

As shown in FIG. 1, the control method of anti-liquid-return of a multi-split air conditioning system may include following steps.

At S1, when the multi-split air conditioning system works in a heating mode, the multi-split air conditioning system is controlled to switch to a defrosting mode to perform defrosting if a defrosting instruction is received by the outdoor unit.

In an embodiment of the present disclosure, the multi-split air conditioning system is in a main heating mode or a pure heating mode when the multi-split air conditioning system works in a heating mode.

Specifically, as shown in FIG. 2, the multi-split air conditioning system includes for example four indoor units, and works in a pure heating mode. When the multi-split air conditioning system works in the pure heating mode, a first port a is communicated with a fourth port d and a second port b is communicated with a third port c in the four-way valve. High-temperature and high-pressure gaseous refrigerant from an outlet of the compressor passes through an oil separator, a four-way valve and a one-way valve F10 and enters a high-pressure gas-liquid separator of the shunt device, and then passes through heating electromagnetic valves SVH1-SVH4 respectively into the indoor units for heating. Liquid refrigerant from outlets of the indoor units flows through a second heat exchanging assembly, a throttling element EXV2 and a first heat exchanging assembly via the one-way valves RV1-RV4, and then enters the outdoor heat exchanger via a one-way valve F9 and at least one heat exchanging channel to be evaporated. After being evaporated by the outdoor heat exchanger, the refrigerant can enter the low-pressure gas-liquid separator of the outdoor unit via a one-way valve F5 and the four-way valve so as to return to the compressor.

When the multi-split air conditioning system works in a defrosting mode, the flow path of the refrigerant in the multi-split is similar to that when the multi-split air conditioning system works in a refrigerating mode. A pure refrigerating mode is taken as an example, as shown in FIG. 2, the four-way valve is switched for the first time, the first port a is communicated with the second port b, and the fourth port d is communicated with the third port c. The high-temperature and high-pressure gaseous refrigerant from the outlet of the compressor passes through the oil separator and the four-way valve, and then passes through a one-way valve F1 and at least one heat exchanging channel, so as to directly enter the outdoor heat exchanger to defrost the outdoor heat exchanger. Subsequently, most of the refrigerant enters the high-pressure gas-liquid separator of the throttling device via a one-way valve F6, and then enters the indoor units through the first heat exchanging assembly, another throttling element EXV1, the second heat exchanging assembly, and one-way valves RV5-RV8, followed by being back to the outdoor unit via cooling electromagnetic valves SVC1-SVC4. A part of the refrigerant is returned to the outdoor unit via the throttling element EXV2. Specifically, in the outdoor unit, the refrigerant may enter the low-pressure gas-liquid separator via a one-way valve F8 and the four-way valve to return to the compressor.

At S2, a gas discharge pressure, a gas return pressure and a gas discharge temperature of the compressor are detected in real time.

At S3, after defrosting is completed, a defrosting completion signal is sent to the shunt device from the outdoor unit, the compressor is controlled to reduce frequency and a plurality of electric control valves are controlled to open, and one of the plurality of electric control valves is controlled to open and the rest of the plurality of electric control valves are controlled to close when the four-way valve switches, so as to reduce an amount of a refrigerant returned to the low-pressure gas-liquid separator, and the number of open electric control valves is adjusted in a preset period according to the gas discharge pressure, the gas return pressure and the gas discharge temperature.

After the defrosting is completed, the compressor is controlled to reduce frequency and a plurality of electric control valves are controlled to open. In an embodiment of the present disclosure, as shown in FIG. 2, the outdoor heat exchanging assembly includes three heat exchanging parts A, B and C, which corresponds to three heat exchanging channels, and a first electric control valve SV3A, a second electric control valve SV3B and a third electric control valve SV3C are provided in the three heat exchanging channels, respectively. Meanwhile, the multi-split air conditioning system is switched to the heating mode again, and the four-way valve switches for the second time, such that the first port a is communicated to the fourth port d and the second port b is communicated with the third port c again. When the four-way valve switches, the first electric control valve SV3A and the second electric control valve SV3B are controlled to close and the third electric control valve SV3C is controlled to open. Therefore, the amount of refrigerant entering the low-pressure gas-liquid separator of the outdoor unit can be preliminarily reduced to prevent that excessive refrigerant in the low-pressure gas-liquid separator returns to the compressor, which may cause compression of the liquid in the compressor.

In addition, in this period, a gas discharge pressure PC, a gas return pressure PE and a gas discharge temperature TP may be determined respectively.

The second electric control valve SV3B is controlled to open and the first electric control valve SV3A is controlled to remain closed, i.e., the second electric control valve SV3B and the third electric control valve SV3C are opened and the first electric control valve SV3A is closed, when the gas discharge pressure PC is higher than or equal to a first high pressure threshold Q1, the gas return pressure PE is lower than a first low pressure threshold P1, or the gas discharge temperature TP is higher than or equal to a first temperature threshold R1.

The first electric control valve SV3A is controlled to open, i.e., all the electric control valves SV3A-SV3C are opened, when the gas discharge pressure PC is higher than or equal to a second high pressure threshold Q2, the gas return pressure PE is lower than a second low pressure threshold P2, or the gas discharge temperature TP is higher than or equal to a second temperature threshold R2, in which the second high pressure threshold Q2 is greater than the first high pressure threshold Q1, the second low pressure threshold P2 is smaller than the first low pressure threshold P1, and the second temperature threshold R2 is greater than the first temperature threshold R1. On this basis, the number of open electric control valves of the first, second and third electric control valves SV3A-SV3C is adjusted for a preset period.

Specifically, specific values of Q1, Q2, P1, P2, R1 and R2 and a length of the preset period may be set according to specific conditions such as the amount of the refrigerant in the multi-split air conditioning system, the performance of the compressor and the specification of the low-pressure gas-liquid separator.

Therefore, after the defrosting is completed, by reducing the number of the open electric control valves, it is possible to prevent the refrigerant amount from being too large and the liquid from returning to the compressor. By increasing the number of the open electric control valves, it is possible to prevent the refrigerant amount from being too small and to prevent the lack of refrigerant in the compressor.

In addition, embodiments of the present disclosure provide a non-transitory computer-readable storage medium having stored therein computer programs that, when executed by a processor, cause the processor to perform a control method of anti-liquid-return described as above.

With the control method of anti-liquid-return of a multi-split air conditioning system according to embodiments of the present disclosure, when the multi-split air conditioning system works in a heating mode, the multi-split air conditioning system is controlled to switch to a defrosting mode to perform defrosting if a defrosting instruction is received. After defrosting is completed, when the four-way valve switches, the number of open electric control valves are decreased to reduce the amount of the refrigerant returned to the outdoor unit and the number of open electric control valves is adjusted in the preset period according to the gas discharge pressure, the gas return pressure and the gas discharge temperature. Therefore, proper functioning of the multi-split air conditioning system may be ensured, and the risk of the liquid returning to the compressor after the defrosting may also be prevented, thus improving the safety and reliability of the system.

In order to realize the control method of anti-liquid-return of a multi-split air conditioning system provided by above embodiments, embodiments of the present disclosure provide a multi-split air conditioning system.

As shown in FIG. 2, the multi-split air conditioning system according to the present disclosure includes a plurality of indoor units 10, an outdoor unit 20 and a shunt device 30.

Specifically, the outdoor unit 20 includes a compressor 21, a four-way valve 22, a low-pressure gas-liquid separator 25 and an outdoor heat exchanging assembly 24. The outdoor heat exchanging assembly 24 includes a plurality of heat exchanging channels and a plurality of heat exchanging units each communicating with a respective one of a plurality of heat exchanging channels, an electric control valve is provided in each heat exchanging channel. Specifically, the electric control valve is an electromagnetic valve. In an embodiment of the present disclosure, as shown in FIG. 2, the outdoor heat exchanging assembly includes three heat exchanging parts A, B and C, which corresponds to three heat exchanging channels, and a first electric control valve SV3A, a second electric control valve SV3B and a third electric control valve SV3C are provided in the three heat exchanging channels, respectively.

In an embodiment of the present disclosure, the multi-split air conditioning system further includes a detecting module and a controlling module (not shown in FIG. 2). The detecting module is configured to detect a gas discharge pressure, a gas return pressure and a gas discharge temperature of the compressor 21 in real time. The controlling module is configured to control the multi-split air conditioning system to switch to a defrosting mode to perform defrosting if a defrosting instruction is received by the outdoor unit 20 when the multi-split air conditioning system works in a heating mode.

In an embodiment of the present disclosure, after the defrosting is completed, a defrosting completion signal is sent to the shunt device 30 from the outdoor unit 20, the compressor 21 is controlled to reduce frequency, a plurality of electric control valves are controlled to open, and one of the plurality of electric control valves is controlled to open and the rest of the plurality of electric control valves are controlled to close when the four-way valve 22 switches, so as to reduce an amount of a refrigerant returned to the low-pressure gas-liquid separator 25, and the number of open electric control valves is adjusted in a preset period according to the gas discharge pressure, the gas return pressure and the gas discharge temperature.

In an embodiment of the present disclosure, the multi-split air conditioning system is in a main heating mode or a pure heating mode when the multi-split air conditioning system works in a heating mode.

Specifically, as shown in FIG. 2, the multi-split air conditioning system includes for example four indoor units 10, and works in a pure heating mode. When the multi-split air conditioning system works in the pure heating mode, a first port a is communicated with a fourth port d and a second port b is communicated with a third port c in the four-way valve 22. High-temperature and high-pressure gaseous refrigerant from an outlet of the compressor 21 passes through an oil separator 23, a four-way valve 22 and a one-way valve F10 and enters a high-pressure gas-liquid separator 33 of the shunt device 30, and then passes through heating electromagnetic valves SVH1-SVH4 respectively into the indoor units 10 for heating. Liquid refrigerant from outlets of the indoor units 10 flows through a second heat exchanging assembly 32, a throttling element EXV2 and a first heat exchanging assembly 31 via the one-way valves RV1-RV4, and then enters the outdoor heat exchanger 24 via a one-way valve F9 and at least one heat exchanging channel to be evaporated. After being evaporated by the outdoor heat exchanger 24, the refrigerant can enter the low-pressure gas-liquid separator 25 of the outdoor unit 20 via a one-way valve F5 and the four-way valve 22 so as to return to the compressor 21.

When the multi-split air conditioning system works in a defrosting mode, the flow path of the refrigerant in the multi-split is similar to that when the multi-split air conditioning system works in a refrigerating mode. A pure refrigerating mode is taken as an example, as shown in FIG. 2, the four-way valve 22 is switched for the first time, the first port a is communicated with the second port b, and the fourth port d is communicated with the third port c. The high-temperature and high-pressure gaseous refrigerant from the outlet of the compressor 21 passes through the oil separator 23 and the four-way valve 22, and then passes through a one-way valve F1 and at least one heat exchanging channel, so as to directly enter the outdoor heat exchanger 24 to defrost the outdoor heat exchanger 24. Subsequently, most of the refrigerant enters the high-pressure gas-liquid separator of the throttling device 30 via a one-way valve F6, and then enters the indoor units 10 through the first heat exchanging assembly 31, another throttling element EXV1, the second heat exchanging assembly 32, and one-way valves RV5-RV8, followed by being back to the outdoor unit 20 via cooling electromagnetic valves SVC1-SVC4. A part of the refrigerant is returned to the outdoor unit 20 via the throttling element EXV2. Specifically, in the outdoor unit 20, the refrigerant may enter the low-pressure gas-liquid separator 25 via a one-way valve F8 and the four-way valve 22 to return to the compressor 21.

In an embodiment of the present disclosure, after the defrosting is completed, the compressor 21 is controlled to reduce frequency and a plurality of electric control valves SV3A-SV3C are controlled to open. Meanwhile, the multi-split air conditioning system is switched to the heating mode again, and the four-way valve 22 switches for the second time, such that the first port a is communicated to the fourth port d and the second port b is communicated with the third port c again in the four-way valve 22. When the four-way valve 22 switches, the first electric control valve SV3A and the second electric control valve SV3B are controlled to close and the third electric control valve SV3C is controlled to open. Therefore, the amount of refrigerant entering the low-pressure gas-liquid separator 25 of the outdoor unit 20 can be preliminarily reduced to prevent that excessive refrigerant in the low-pressure gas-liquid separator 25 returns to the compressor 21, which may cause compression of the liquid in the compressor 21.

In addition, in this period, the outdoor unit 20 is configured to determine a gas discharge pressure PC, a gas return pressure PE and a gas discharge temperature TP respectively. The second electric control valve SV3B is controlled to open and the first electric control valve SV3A is controlled to remain closed, i.e., the second electric control valve SV3B and the third electric control valve SV3C are opened and the first electric control valve SV3A is closed, when the gas discharge pressure PC is higher than or equal to a first high pressure threshold Q1, the gas return pressure PE is lower than a first low pressure threshold P1, or the gas discharge temperature TP is higher than or equal to a first temperature threshold R1. The first electric control valve SV3A is controlled to open, i.e., all the electric control valves SV3A-SV3C are opened, when the gas discharge pressure PC is higher than or equal to a second high pressure threshold Q2, the gas return pressure PE is lower than a second low pressure threshold P2, or the gas discharge temperature TP is higher than or equal to a second temperature threshold R2, in which the second high pressure threshold Q2 is higher than the first high pressure threshold Q1, the second low pressure threshold P2 is lower than the first low pressure threshold P1, and the second temperature threshold R2 is higher than the first temperature threshold R1. On this basis, the number of open electric control valves of the first, second and third electric control valves SV3A-SV3C is adjusted for a preset period.

Specifically, specific values of Q1, Q2, P1, P2, R1 and R2 and a length of the preset period may be set according to specific conditions such as the amount of the refrigerant in the multi-split air conditioning system, the performance of the compressor 21 and the specification of the low-pressure gas-liquid separator 25.

Therefore, after the defrosting is completed, by reducing the number of the open electric control valves, it is possible to prevent the refrigerant amount from being too large and the liquid from returning to the compressor 21. By increasing the number of the open electric control valves, it is possible to prevent the refrigerant amount from being too small and to prevent the lack of refrigerant in the compressor 21.

With the multi-split air conditioning system according to embodiments of the present disclosure, when the multi-split air conditioning system works in heating mode, the multi-split air conditioning system is controlled to switch to a defrosting mode to perform defrosting if a defrosting instruction is received by the outdoor unit. After defrosting is completed, when the four-way valve switches, the number of open electric control valves are decreased to reduce the amount of the refrigerant returned to the outdoor unit and the number of open electric control valves is adjusted in the preset period according to the gas discharge pressure, the gas return pressure and the gas discharge temperature. Therefore, proper functioning of the multi-split air conditioning system may be ensured, and the risk of the liquid returning to the compressor after the defrosting may also be prevented, thus improving the safety and reliability of the system.

In the specification, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise" and "counterclockwise" should be construed to refer to the orientation as described or as shown in the drawings under discussion. These relative terms are for convenience of description and do not require that the present disclosure be constructed or operated in a particular orientation, and thus shall not be construed to limit the present disclosure In addition, terms such as "first" and "second" are used herein for purposes of description and are not intended to indicate or imply relative importance or significance or to imply the number of indicated technical features. Thus, the feature defined with "first" and "second" may include one or more of this feature(s). In the description of the present disclosure, unless specified otherwise, "a plurality of" means two or more.

In the present disclosure, unless specified or limited otherwise, the terms "mounted", "communicated", "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, architecture, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, architectures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A control method of anti-liquid-return of a multi-split air conditioning system, wherein the multi-split air conditioning system comprises an outdoor unit, a shunt device and a plurality of indoor units, wherein the outdoor unit comprises a low-pressure gas-liquid separator, a compressor, a four-way valve and an outdoor heat exchanging assembly, the outdoor heat exchanging assembly comprises a plurality of heat exchanging channels, an electric control valve is provided in each heat exchanging channel, the method comprising:

while the multi-split air conditioning system works in a heating mode:

controlling the multi-split air conditioning system to switch to a defrosting mode to perform defrosting after a defrosting instruction is received by the outdoor unit;

detecting a gas discharge pressure, a gas return pressure and a gas discharge temperature of the compressor in real time;

after defrosting is completed:

sending a defrosting completion signal to the shunt device from the outdoor unit;

controlling the compressor to reduce frequency and a plurality of electric control valves to open;

controlling one of the plurality of electric control valves to open and the rest of the plurality of electric control valves to close when the four-way valve switches, so as to reduce an amount of a refrigerant returned to the low-pressure gas-liquid separator; and adjusting the number of open electric control valves in a preset period according to the gas discharge pressure, the gas return pressure and the gas discharge temperature, wherein the shunt device includes a high-pressure gas-liquid separator and a plurality of heating electromagnetic valves.

2. The method according to claim 1, wherein the plurality of electric control valves consists of a first electric control valve, a second electric control valve and a third electric control valve when the number of the heat exchanging channels is three, and the first electric control valve and the second electric control valve are controlled to close and the third electric control valve is controlled to open when the four-way valve switches.

3. The method according to claim 2, wherein adjusting the number of open electric control valves in a preset period according to the gas discharge pressure, the gas return pressure and the gas discharge temperature comprises:

determining the gas discharge pressure, the gas return pressure and the gas discharge temperature; and controlling the second electric control valve to open and the first electric control valve to remain closed includes opening the second and third electric control valves and keeping the first electric control valve closed, when the gas discharge pressure is higher than or equal to a first high pressure threshold, the gas return pressure is lower than a first low pressure threshold, or the gas discharge temperature is higher than or equal to a first temperature threshold.

4. The method according to claim 3, wherein adjusting the number of open electric control valves in a preset period according to the gas discharge pressure, the gas return pressure and the gas discharge temperature further comprises:

controlling the first electric control valve to open includes opening all the electric control valves, when the gas discharge pressure is higher than or equal to a second high pressure threshold, the gas return pressure is lower than a second low pressure threshold, or the gas discharge temperature is higher than or equal to a second temperature threshold, in which the second high pressure threshold is greater than the first high pressure threshold, the second low pressure threshold is smaller than the first low pressure threshold, and the second temperature threshold is greater than the first temperature threshold.

5. The method according to claim 1, wherein the multi-split air conditioning system is in a heating mode.

6. A multi-split air conditioning system, comprising:

a plurality of indoor units;

a shunt device that includes a high-pressure gas-liquid separator, and a plurality of heating electromagnetic valves;

an outdoor unit, the outdoor unit further comprising a low-pressure gas-liquid separator, a compressor, a four-way valve and an outdoor heat exchanging assembly, the outdoor heat exchanging assembly comprising a plurality of heat exchanging channels and, an electric control valve is provided in each heat exchanging channel;

a detecting module comprising a temperature sensor and a pressure sensor, configured to detect a gas discharge pressure, a gas return pressure and a gas discharge temperature of the compressor in real time;

a controlling module comprising a controller, configured to control the multi-split air conditioning system to switch to a defrosting mode to perform defrosting after a defrosting instruction is received by the outdoor unit while the multi-split air conditioning system works in a heating mode, wherein after defrosting is completed, a defrosting completion signal is sent to the shunt device from the outdoor unit, the compressor is controlled to reduce frequency, a plurality of electric control valves are controlled to open, and one of the plurality of electric control valves is controlled to open and the rest of the plurality of electric control valves are controlled to close when the four-way valve switches, so as to reduce an amount of a refrigerant returned to the low-pressure gas-liquid separator, and the number of open electric control valves is adjusted in a preset period according to the gas discharge pressure, the gas return pressure and the gas discharge temperature, wherein the shunt device includes a high-pressure gas-liquid separator and a plurality of heating electromagnetic valves.

7. The multi-split air conditioning system according to claim 6, wherein the plurality of electric controlled valves consists of a first electric control valve, a second electric control valve and a third electric control valve when the number of heat exchanging channels is three, and the outdoor unit is configured to control the first electric control valve and the second electric control valve to close and the third electric control valve to open when the four-way valve switches.

8. The multi-split air conditioning system according to claim 7, wherein the outdoor unit is configured to determine the gas discharge pressure, the gas return pressure and the gas discharge temperature, the outdoor unit is configured to control the second electric control valve to open and the first electric control valve to remain closed includes to open the second and third electric control valves and to keep the first electric control valve closed, when the gas discharge pressure is higher than or equal to a first high pressure threshold, the gas return pressure is lower than a first low pressure threshold, or the gas discharge temperature is higher than or equal to a first temperature threshold.

9. The multi-split air conditioning system according to claim 8, wherein the outdoor unit is configured to control the first electric control valve to open includes to open all the electric control valves, when the gas discharge pressure is higher than or equal to a second high pressure threshold, the gas return pressure is lower than a second low pressure threshold, or the gas discharge temperature is higher than or equal to a second temperature threshold, in which the second high pressure threshold is greater than the first high pressure threshold, the second low pressure threshold is smaller than the first low pressure threshold, and the second temperature threshold is greater than the first temperature threshold.

10. The multi-split air conditioning system according to claim 9, wherein the multi-split air conditioning system is in a heating mode.

11. A non-transitory computer-readable storage medium having stored therein computer programs that, when executed by a processor, cause the processor to perform a control method of anti-liquid-return of a multi-split air conditioning system, wherein the multi-split air conditioning system comprises an outdoor unit, a shunt device and a plurality of indoor units, wherein the outdoor unit comprises a low-pressure gas-liquid separator, a compressor, a four-way valve and an outdoor heat exchanging assembly, the shunt device includes a high-pressure gas-liquid separator and a plurality of heating electromagnetic valves, the outdoor heat exchanging assembly comprises a plurality of heat exchanging channels and, an electric control valve is provided in each heat exchanging channel, by:

while the multi-split air conditioning system works in a heating mode:

controlling the multi-split air conditioning system to switch to a defrosting mode to perform defrosting after a defrosting instruction is received by the outdoor unit;

detecting a gas discharge pressure, a gas return pressure and a gas discharge temperature of the compressor in real time;

after defrosting is completed:

sending a defrosting completion signal to the shunt device from the outdoor unit;

controlling the compressor to reduce frequency and a plurality of electric control valves to open;

controlling one of the plurality of electric control valves to open and the rest of the plurality of electric control valves to close when the four-way valve switches, so as to reduce an amount of a refrigerant returned to the low-pressure gas-liquid separator; and adjusting the number of open electric control valves in a preset period according to the gas discharge pressure, the gas return pressure and the gas discharge temperature.

12. The non-transitory computer-readable storage medium according to claim 11, wherein the plurality of electric control valves consists of a first electric control valve, a second electric control valve and a third electric control valve when the number of the heat exchanging channels is three, and the first electric control valve and the second electric control valve are controlled to close and the third electric control valve is controlled to open when the four-way valve switches.

13. The non-transitory computer-readable storage medium according to claim 12, wherein adjusting the number of open electric control valves in a preset period according to the gas discharge pressure, the gas return pressure and the gas discharge temperature comprises:

determining the gas discharge pressure, the gas return pressure and the gas discharge temperature; and controlling the second electric control valve to open and the first electric control valve to remain closed includes opening the second and third electric control valves and keeping the first electric control valve closed, when the gas discharge pressure is higher than or equal to a first high pressure threshold, the gas return pressure is lower than a first low pressure threshold, or the gas discharge temperature is higher than or equal to a first temperature threshold.

14. The non-transitory computer-readable storage medium according to claim 13, wherein adjusting the number of open electric control valves in a preset period according to the gas discharge pressure, the gas return pressure and the gas discharge temperature further comprises:

controlling the first electric control valve to open includes opening all the electric control valves, when the gas discharge pressure is higher than or equal to a second high pressure threshold, the gas return pressure is lower than a second low pressure threshold, or the gas discharge temperature is higher than or equal to a second temperature threshold, in which the second high pressure threshold is greater than the first high pressure threshold, the second low pressure threshold is smaller than the first low pressure threshold, and the second temperature threshold is greater than the first temperature threshold.

15. The non-transitory computer-readable storage medium according to claim 11, wherein the multi-split air conditioning system is in a heating mode.

* * * * *